US012043990B2

(12) United States Patent
Yoshimoto et al.

(10) Patent No.: US 12,043,990 B2
(45) Date of Patent: Jul. 23, 2024

(54) TRACK FOLLOWING SYSTEM, TRACK FOLLOWING METHOD, AND COMPUTER READABLE MEDIUM

(71) Applicant: NEC Corporation, Tokyo (JP)

(72) Inventors: Tatsuya Yoshimoto, Tokyo (JP); Hiroshi Yoshida, Tokyo (JP)

(73) Assignee: NEC CORPORATION, Tokyo (JP)

( * ) Notice: Subject to any disclaimer, the term of this patent is extended or adjusted under 35 U.S.C. 154(b) by 433 days.

(21) Appl. No.: 17/426,742

(22) PCT Filed: Jan. 29, 2020

(86) PCT No.: PCT/JP2020/003103
§ 371 (c)(1),
(2) Date: Jul. 29, 2021

(87) PCT Pub. No.: WO2020/158779
PCT Pub. Date: Aug. 6, 2020

(65) Prior Publication Data

US 2022/0098835 A1 Mar. 31, 2022

(30) Foreign Application Priority Data

Jan. 30, 2019 (JP) ..... 2019-014687

(51) Int. Cl.
*E02F 9/26* (2006.01)
*E02F 3/32* (2006.01)

(52) U.S. Cl.
CPC ..... *E02F 9/265* (2013.01); *E02F 3/32* (2013.01)

(58) Field of Classification Search
CPC ..... E02F 9/265; E02F 3/32
See application file for complete search history.

(56) References Cited

U.S. PATENT DOCUMENTS 11,702,819 B2 * 7/2023 Vanderlinde ..... E02F 9/265 701/50
2003/0019132 A1 1/2003 Kurenuma et al.
(Continued)

FOREIGN PATENT DOCUMENTS

| | | | |
|---|---|---|---|
| JP | H10212740 | A | 8/1998 |
| JP | H11264155 | A | 9/1999 |
| WO | 2011114974 | A1 | 9/2011 |

OTHER PUBLICATIONS

International Search Report for PCT Application No. PCT/JP2020/003103, mailed on Mar. 24, 2020.

*Primary Examiner* — Peter D Nolan
*Assistant Examiner* — Wae L Louie

(57) ABSTRACT

A convergence determination unit determines whether a state of the bucket has converged to a current target state. A target state update unit is configured to update a target state of the bucket when the convergence determination unit determines that the state of the bucket has converged to the current target state. The convergence determination unit includes a first convergence determination unit and a second convergence determination unit. The first convergence determination unit determines whether a swing angle of each mechanism has converged to the corresponding target swing angle under a first convergence condition. The second convergence determination unit determines whether a swing angle of each mechanism has converged to the corresponding target swing angle under a second convergence condition, which is stricter than the first convergence condition.

7 Claims, 6 Drawing Sheets

(56) References Cited

U.S. PATENT DOCUMENTS

| | | | | |
|---|---|---|---|---|
| 2012/0144704 | A1* | 6/2012 | Cone | E02F 3/6481 37/413 |
| 2012/0330515 | A1* | 12/2012 | Numazaki | E02F 9/2207 701/50 |
| 2013/0297046 | A1* | 11/2013 | Hendron | E02F 9/265 700/56 |
| 2016/0222630 | A1* | 8/2016 | Friend | B33Y 50/02 |
| 2017/0121929 | A1* | 5/2017 | Martinez | E02F 9/2203 |
| 2019/0301131 | A1* | 10/2019 | Hendron | E02F 9/265 |
| 2019/0301144 | A1* | 10/2019 | Kean | E02F 9/265 |
| 2019/0330820 | A1* | 10/2019 | Bellows | B66C 13/40 |
| 2021/0285187 | A1* | 9/2021 | Jagoda | E02F 9/264 |
| 2022/0098835 | A1* | 3/2022 | Yoshimoto | E02F 3/439 |

* cited by examiner

| TARGET STATE | TARGET COORDINATE | | TARGET ABSOLUTE POSTURE | TARGET SWING ANGLE | | | FIRST THRESHOLD VALUE OF FIRST CONVERGENCE CONDITION | | | SECOND THRESHOLD VALUE OF SECOND CONVERGENCE CONDITION | | |
|---|---|---|---|---|---|---|---|---|---|---|---|---|
| | xr | yr | θr | θr1 | θr2 | θr3 | δ1 | δ2 | δ3 | ε1 | ε2 | ε3 |
| P1 | xr(1) | yr(1) | θr(1) | θr1(1) | θr2(1) | θr3(1) | δ1(A) | δ2(A) | δ3(A) | ε1(A) | ε2(A) | ε3(A) |
| P2 | xr(2) | yr(2) | θr(2) | θr1(2) | θr2(2) | θr3(2) | | | | | | |
| P3 | xr(3) | yr(3) | θr(3) | θr1(3) | θr2(3) | θr3(3) | | | | | | |
| P4 | xr(4) | yr(4) | θr(4) | θr1(4) | θr2(4) | θr3(4) | | | | | | |
| P5 | xr(5) | yr(5) | θr(5) | θr1(5) | θr2(5) | θr3(5) | | | | | | |
| P6 | xr(6) | yr(6) | θr(6) | θr1(6) | θr2(6) | θr3(6) | | | | | | |
| P7 | xr(7) | yr(7) | θr(7) | θr1(7) | θr2(7) | θr3(7) | | | | | | |
| P8 | xr(8) | yr(8) | θr(8) | θr1(8) | θr2(8) | θr3(8) | δ1(B) | δ2(B) | δ3(B) | ε1(B) | ε2(B) | ε3(B) |
| P9 | xr(9) | yr(9) | θr(9) | θr1(9) | θr2(9) | θr3(9) | | | | | | |
| P10 | xr(10) | yr(10) | θr(10) | θr1(10) | θr2(10) | θr3(10) | | | | | | |

Fig. 5

TRACK FOLLOWING SYSTEM, TRACK FOLLOWING METHOD, AND COMPUTER READABLE MEDIUM

This application is a National Stage Entry of PCT/JP2020/003103 filed on Jan. 29, 2020, which claims priority from Japanese Patent Application 2019-014687 filed on Jan. 30, 2019, the contents of all of which are incorporated herein by reference, in their entirety.

TECHNICAL FIELD

The present invention relates to a track following system, a track following method, and a computer readable medium.

BACKGROUND ART

Patent Literature 1 discloses an automatic excavation method for a hydraulic excavator for automatically throwing earth and sand into a dump truck, a crusher, or the like. Specifically, the operator first operates the hydraulic excavator and the operation is subsequently stored in the controller by teaching, and thereafter, the controller operates the hydraulic excavator instead of the operator.

CITATION LIST

Patent Literature

[Patent Literature 1] Japanese Unexamined Patent Application Publication No. H10-212740

SUMMARY OF INVENTION

Technical Problem

It is conceivable that, when the hydraulic excavator is automatically controlled, for example, the operator inputs the target track of the bucket into the control device in advance, and this control device moves the bucket along the target track. It is then conceivable that, for example, the control device sets a plurality of target points on the target track, and when it is determined that the bucket has converged near the i-th target point, the controller repeatedly updates the target state of the bucket so that the bucket moves toward the (i+1)th target point. However, there is still room for improvement regarding the above-mentioned convergence determination.

An object of the present disclosure is to provide a technique for solving any of the above-mentioned problems.

Solution to Problem

According to a first aspect of the present disclosure, there is provided a track following system configured to control an end effector to follow a target track in a work machine having a plurality of mechanisms including the end effector and at least one support unit configured to support the end effector. The track following system comprises the following: a target state update unit configured to update a target state including at least a target coordinate of the end effector; a target relative posture calculation unit configured to calculate respective target relative postures of the plurality of mechanisms based on a current target state of the end effector; a relative posture control unit configured to control relative postures of the plurality of mechanisms so that each of the relative postures of the plurality of mechanisms approaches a corresponding target relative posture; and a convergence determination unit configured to determine whether a state of the end effector has converged to a current target state. The target state update unit is configured to update a target state of the end effector when the convergence determination unit determines that a state of the end effector has converged to a current target state. The convergence determination unit includes a first convergence determination unit configured to determine whether a relative posture of each mechanism has converged to the corresponding target relative posture under a first convergence condition. The convergence determination unit includes a second convergence determination unit configured to determine whether a relative posture of each mechanism has converged to the corresponding target relative posture under a second convergence condition, the second convergence condition being stricter than the first convergence condition.

According to a second aspect of the present disclosure, there is provided a track following method configured to control an end effector to follow a target track in a work machine having a plurality of mechanisms including the end effector and at least one support unit configured to support the end effector. The track following method comprises the following: a target state update step of updating a target state including at least a target coordinate of the end effector; a target relative posture calculation step of calculating respective target relative postures of the plurality of mechanisms based on a current target state of the end effector; a relative posture control step of controlling relative postures of the plurality of mechanisms so that each of the relative postures of the plurality of mechanisms approaches a corresponding target relative posture; and a convergence determination step of determining whether a state of the end effector has converged to a current target state. The target state update step updates a target state of the end effector when the convergence determination step determines that a state of the end effector has converged to a current target state. The convergence determination step includes a first convergence determination step of determining whether a relative posture of each mechanism has converged to the corresponding target relative posture under a first convergence condition. The convergence determination step includes a second convergence determination step of determining whether a relative posture of each mechanism has converged to the corresponding target relative posture under a second convergence condition, the second convergence condition being stricter than the first convergence condition.

Advantageous Effects of Invention

According to the present invention, a new technique relating to convergence determination is provided.

BRIEF DESCRIPTION OF THE DRAWINGS

FIG. 5 is a table showing target states and convergence conditions. (Second example embodiment)

DESCRIPTION OF EMBODIMENTS

First Example Embodiment

Figure 1:
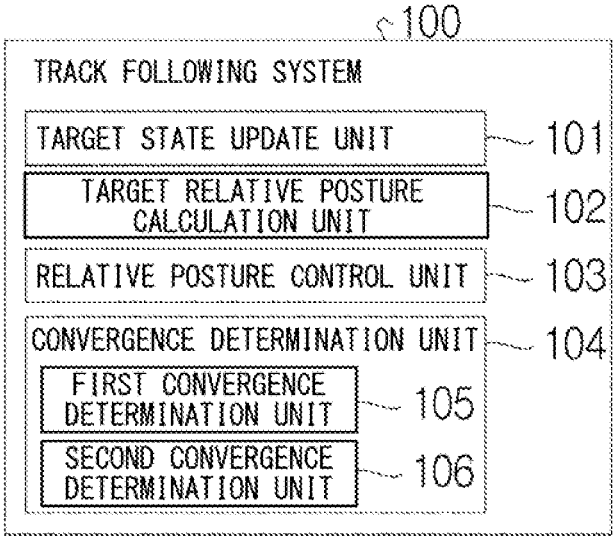
FIG. 1 is a functional block diagram of a track following system. (First example embodiment)

First, a track following system 100 of a first example embodiment is described below with reference to FIG. 1.

The track following system 100 is a system configured to control an end effector to follow the target track in a work machine having a plurality of mechanisms including the end effector and at least one support unit for supporting the end effector. The plurality of mechanisms include an end effector and at least one support unit that supports the end effector.

The track following system 100 includes a target state update unit 101, a target relative posture calculation unit 102, a relative posture control unit 103, and a convergence determination unit 104.

The target state update unit 101 updates the target state including at least a target coordinate of the end effector.

The target relative posture calculation unit 102 calculates the respective target relative postures of the plurality of mechanisms based on the current target state of the end effector.

The relative posture control unit 103 controls the relative postures of the plurality of mechanisms so that each of the relative postures of the plurality of mechanisms approaches the corresponding target relative postures.

The convergence determination unit 104 determines whether the state of the end effector has converged to the current target state.

Then, the target state update unit 101 is configured to update the target state of the end effector when the convergence determination unit 104 determines that the state of the end effector has converged to the current target state.

Furthermore, the convergence determination unit 104 includes a first convergence determination unit 105 and a second convergence determination unit 106.

The first convergence determination unit 105 determines whether the relative posture of each mechanism has converged to the corresponding target relative posture under a first convergence condition.

The second convergence determination unit 106 determines whether the relative posture of each mechanism has converged to the corresponding target relative posture under a second convergence condition, which is stricter than the first convergence condition.

According to the above configuration, a new technique relating to convergence determination is provided. That is, a flexible convergence determination can be achieved.

Second Example Embodiment

Next, a backhoe 1 is described below with reference to FIGS. 2 to 6. The backhoe 1 is a hydraulic excavator having a bucket that mainly faces the main body of the backhoe 1 and excavates toward the main body side. The backhoe 1 is used, for example, when the residual soil discharged from a processing apparatus by a belt conveyor and accumulated in an earth and sand pit is loaded on a dump truck. The backhoe 1 is a specific example of the work machine.

In this example embodiment, the backhoe 1 is exemplified as a work machine. However, the work machine is not limited to the backhoe 1, and may be, for example, a loading excavator, which is a hydraulic excavator excavating toward the traveling direction, or another construction heavy machine. Furthermore, the work machine is not limited to construction heavy machine, and may be various robots in which an end effector is supported by at least one support unit, as represented by an industrial robot, for example.

Figure 2:
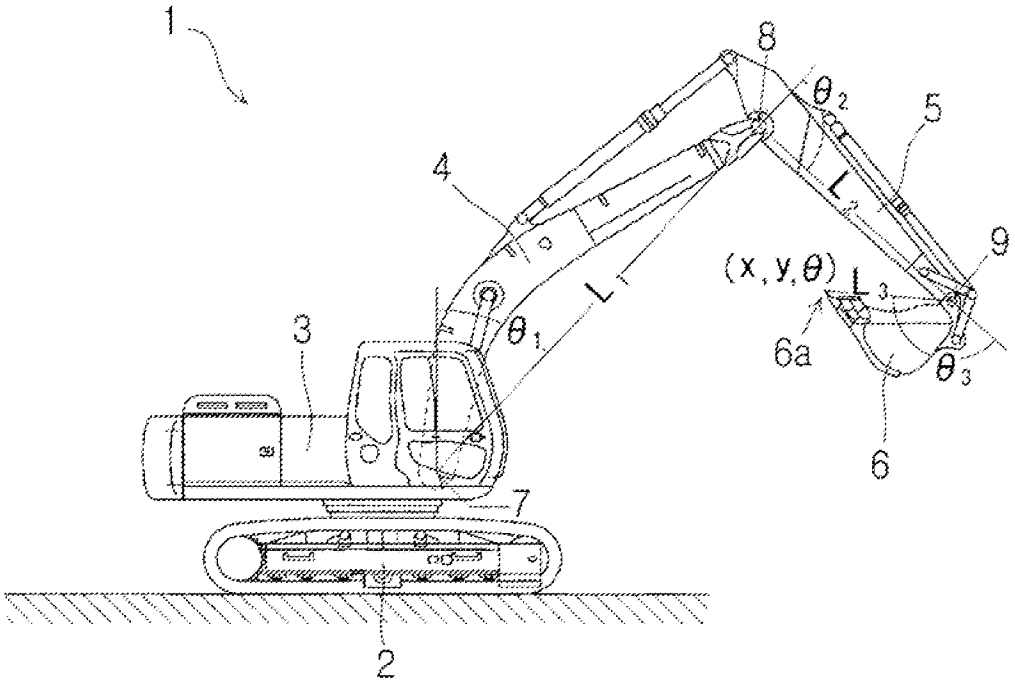
FIG. 2 is a side view of a backhoe. (Second example embodiment)

FIG. 2 shows a side view of the backhoe 1. As shown in FIG. 2, the backhoe 1 includes a lower traveling body 2, a swivel body 3, a boom 4, an arm 5, and a bucket 6.

The swivel body 3 is mounted on the lower traveling body 2 so as to be able to swivel horizontally.

The boom 4 is swingably supported by the swivel body 3 via a first joint 7. The boom 4 is a specific example of a support unit configuring the mechanism.

The arm 5 is swingably supported by the boom 4 via a second joint 8. The arm 5 is a specific example of the support unit configuring the mechanism.

The bucket 6 is swingably supported by the arm 5 via a third joint 9. The bucket 6 is a specific example of the end effector configuring the mechanism. In this example embodiment, three mechanisms including a boom 4, an arm 5, and a bucket 6 are exemplified. However, the mechanism is not limited to these, and the number is not limited to three.

The swivel body 3, the boom 4, the arm 5, and the bucket 6 are connected in series in the order described. Therefore, the bucket 6 is swingably supported by the swivel body 3 via the arm 5 and the boom 4 in the order described. Each of the boom 4, the arm 5, and the bucket 6 herein is a specific example of the mechanism, and therefore may be simply referred to as a "mechanism".

Figure 3:
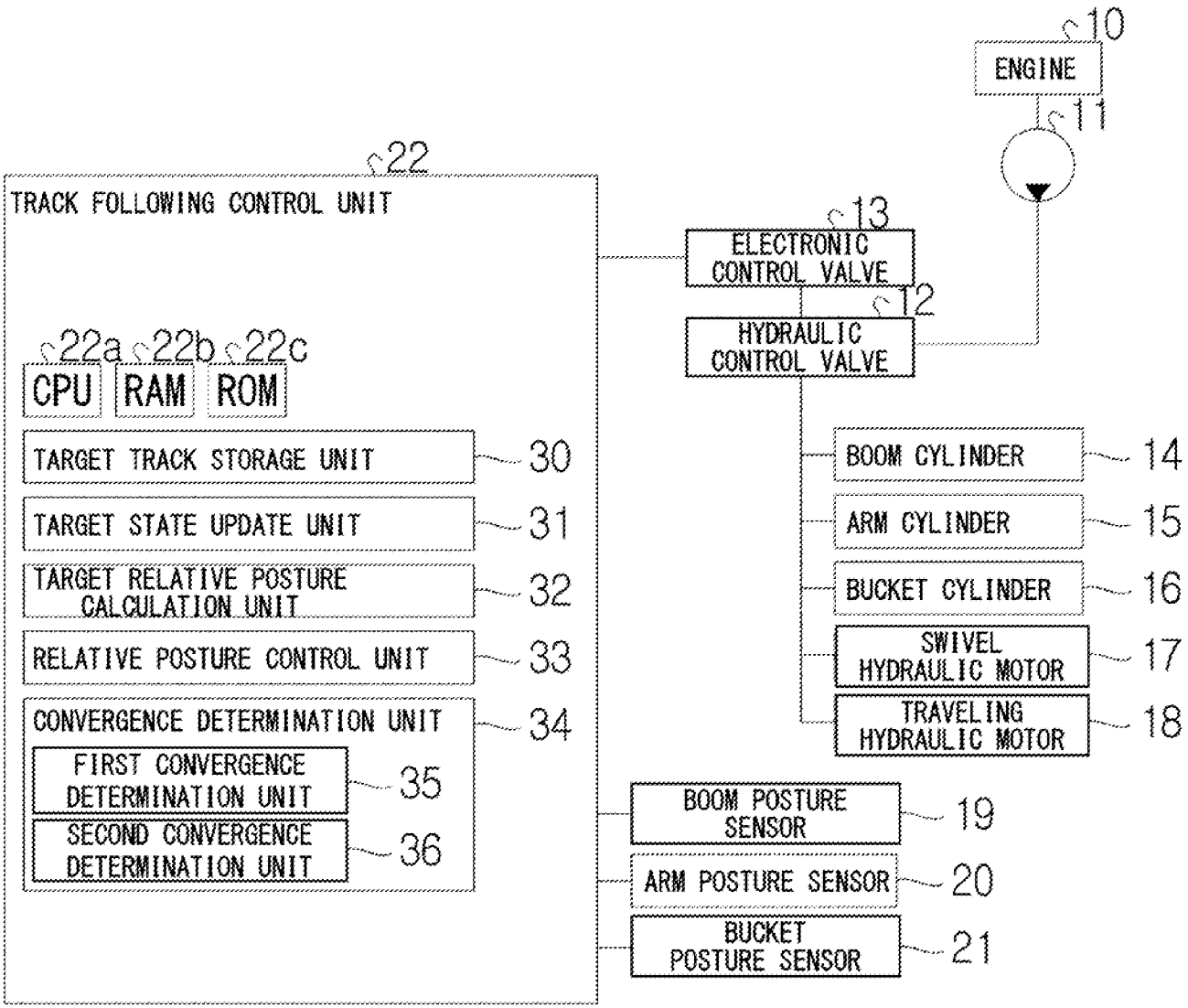
FIG. 3 is a functional block diagram of the backhoe. (Second example embodiment)

FIG. 3 shows a functional block diagram of the backhoe 1. As shown in FIG. 3, the backhoe 1 further includes an engine 10, a hydraulic pump 11, a hydraulic control valve 12, an electronic control valve 13, a boom cylinder 14, an arm cylinder 15, and a bucket cylinder 16. The backhoe 1 also includes a swivel hydraulic motor 17 and a traveling hydraulic motor 18. In addition, the backhoe 1 includes a boom posture sensor 19, an arm posture sensor 20, and a bucket posture sensor 21. The backhoe 1 further includes a track following control unit 22.

The boom cylinder 14, arm cylinder 15, bucket cylinder 16, swivel hydraulic motor 17, and traveling hydraulic motor 18 all operate by receiving pressure oil from the hydraulic pump 11 driven by the engine 10 via the hydraulic control valve 12. The hydraulic control valve 12 receives pilot pressure from the electronic control valve 13 and switches to supply pressure oil to the boom cylinder 14, arm cylinder 15, bucket cylinder 16, swivel hydraulic motor 17, and traveling hydraulic motor 18 as appropriate. The electronic control valve 13 switches in response to a control signal from the track following control unit 22, and supplies the pilot pressure to the hydraulic control valve 12 to switch the hydraulic control valve 12.

The swivel hydraulic motor 17 is a hydraulic motor for swiveling the swivel body 3.

The traveling hydraulic motor 18 is a hydraulic motor for traveling the lower traveling body 2.

The boom posture sensor 19 is a swing angle sensor, which detects the swing angle θ1 of the boom 4 with respect to the swivel body 3 shown in FIG. 2 and outputs the detection result to the track following control unit 22. Here, the swing angle θ1 is an angle between the line segment connecting the first joint 7 to the second joint 8 of the boom 4 and the vertical direction, as shown in FIG. 2. The swing angle θ1 means the relative posture of the boom 4.

The arm posture sensor 20 is a swing angle sensor, which detects the swing angle θ2 of the arm 5 with respect to the boom 4 and outputs the detection result to the track following control unit 22. Here, the swing angle θ2 is an angle between the line segment connecting the second joint 8 to the third joint 9 of the arm 5 and the line segment connecting the first joint 7 to the second joint 8 of the boom 4. The swing angle θ2 means the relative posture of the arm 5.

The bucket posture sensor 21 is a swing angle sensor, which detects a swing angle θ3 with respect to the arm 5 of the bucket 6 and outputs the detection result to the track following control unit 22. Here, the swing angle θ3 is an angle between the line segment connecting the third joint 9 of the bucket 6 to the bucket cutting edge 6*a* and the line segment connecting the second joint 8 to the third joint 9 of the arm 5. The swing angle θ3 means the relative posture of the bucket 6.

The boom posture sensor 19, the arm posture sensor 20, and the bucket posture sensor 21 are configured with, for example, a rotary encoder. However, the boom posture sensor 19 may be configured with a sensor that detects the length of the cylinder of the boom cylinder 14 so that the track following control unit 22 may calculate the swing angle θ1 based on the detection result of this sensor. The boom posture sensor 19 to be adopted also may be an acceleration sensor so that the track following control unit 22 may calculate the swing angle θ1 based on the detection result of the acceleration sensor. The same applies to the arm posture sensor 20 and the bucket posture sensor 21.

Here, with reference to FIG. 2, the relationship of the coordinates and absolute posture of the bucket cutting edge 6*a* with the respective swing angles θ1, 02, and 03 is described below. As shown in FIG. 2, let x be the X coordinate of the bucket cutting edge 6*a*, let y be the Y coordinate thereof, and let 0 be the absolute posture of the bucket cutting edge 6*a*. The absolute posture θ of the bucket cutting edge 6*a* is an angle between the line segment connecting the third joint 9 of the bucket cutting edge 6*a* to the bucket cutting edge 6*a* and the horizontal. Let L1 be the length of the line segment connecting the first joint 7 to the second joint 8 of the boom 4, let L2 be the length of the line segment connecting the second joint 8 to the third joint 9 of the arm 5, and let L3 be the length of the line segment connecting the third joint 9 of the bucket 6 to the bucket cutting edge 6*a*. Then, the X coordinate x, the Y coordinate y and the absolute posture θ, of the bucket 6, are expressed by the following expressions (1) to (3), respectively. Here, the origin of the X coordinate x and the Y coordinate y of the bucket 6 is the first joint 7.

[Expression 1]

$$x=L_1 \sin \theta_1+L_2 \sin(\theta_1+\theta_2)+L_3 \sin \theta_r \tag{1}$$

[Expression 2]

$$y=L_1 \operatorname{Cos} \theta_1+L_2 \operatorname{Cos}(\theta_1+\theta_2)+L_3 \operatorname{Cos} \theta_r \tag{2}$$

[Expression 3]

$$\theta=\theta_1+\theta_2+\theta_3 \tag{3}$$

Therefore, the swing angles θ1, θ2, and θ3 such that the X coordinate x, the Y coordinate y, and the absolute posture θ of the bucket 6 are desired values can be obtained by the following expressions (4) to (12).

[Expression 4]

$$\theta_1 = \varphi_1 \tag{4}$$

[Expression 5]

$$\theta_2 = \varphi_2 - \theta_1 \tag{5}$$

[Expression 6]

$$\theta_3 = \theta - \theta_1 - \theta_2 \tag{6}$$

[Expression 7]

$$\varphi_1 = \tan^{-1}\frac{\lambda_x}{\lambda_y} - \tan^{-1}\frac{\sqrt{\lambda_x^2+\lambda_y^2-\alpha^2}}{\alpha} \tag{7}$$

[Expression 8]

$$\varphi_2 = \tan^{-1}\frac{\lambda_x}{\lambda_y} - \tan^{-1}\frac{-\sqrt{\lambda_x^2+\lambda_y^2-\beta^2}}{\beta} \tag{8}$$

[Expression 9]

$$\lambda_x = x - L_3\sin\theta \tag{9}$$

[Expression 10]

$$\lambda_y = y - L_3\cos\theta \tag{10}$$

[Expression 11]

$$\alpha = \frac{\lambda_x^2+\lambda_y^2+(L_1^2-L_2^2)}{2L_1} \tag{11}$$

[Expression 12]

$$\beta = \frac{\lambda_x^2+\lambda_y^2-(L_1^2-L_2^2)}{2L_2} \tag{12}$$

In the backhoe 1 of this example embodiment, in order to automatically control the bucket 6, first, the X coordinate x, the Y coordinate y, and the absolute posture θ, which are the targets of the bucket 6, are discretely determined according to the target track of the bucket 6. Then, the swing angles θ1, θ2, and θ3 for achieving the X coordinate x, Y coordinate y, and absolute posture θ of the bucket 6 are calculated, and the swing angles θ1, θ2, and θ3 are set to controlled targets in the automatic control. Hereinafter, the X coordinate x, the Y coordinate y, and the absolute posture θ of the bucket 6 are to be referred to as the state of the bucket 6. The target values of the X coordinate x, the Y coordinate y, and the absolute posture θ of the bucket 6 are expressed as the target X coordinate xr, the target Y coordinate yr, and the target absolute posture Or, respectively. The target values of the swing angles θ1, θ2, and θ3 are expressed as the target swing angles θr1, θr2, and θr3, respectively. The subscript r is an acronym for reference, which means an act of looking at something for information.

Next, the track following control unit 22 is described below in detail with reference to FIG. 3.

The track following control unit 22 is a specific example of the track following system. In this example embodiment, the backhoe 1 includes a track following control unit 22. However, the track following control unit 22 may be provided outside the backhoe 1. The track following control unit 22 may be embodied by a single device or may be embodied by a plurality of devices. When the track following control unit 22 is embodied by a plurality of devices, the plurality of devices may be arranged at the same geographical location or at geographically separated locations.

The track following control unit 22 includes a CPU 22*a* as a central processing unit, a freely readable and writable RAM 22*b*, and a read-only ROM 22*c*. Then, the CPU 22*a* reads and executes the control program stored in the ROM 22*c*, so that the control program causes the hardware such as the CPU 22*a* to function as the target track storage unit 30. Similarly, the control program causes hardware such as the CPU 22*a* to function as the target state update unit 31, the target relative posture calculation unit 32, the relative posture control unit 33, and the convergence determination unit 34.

Figure 4:
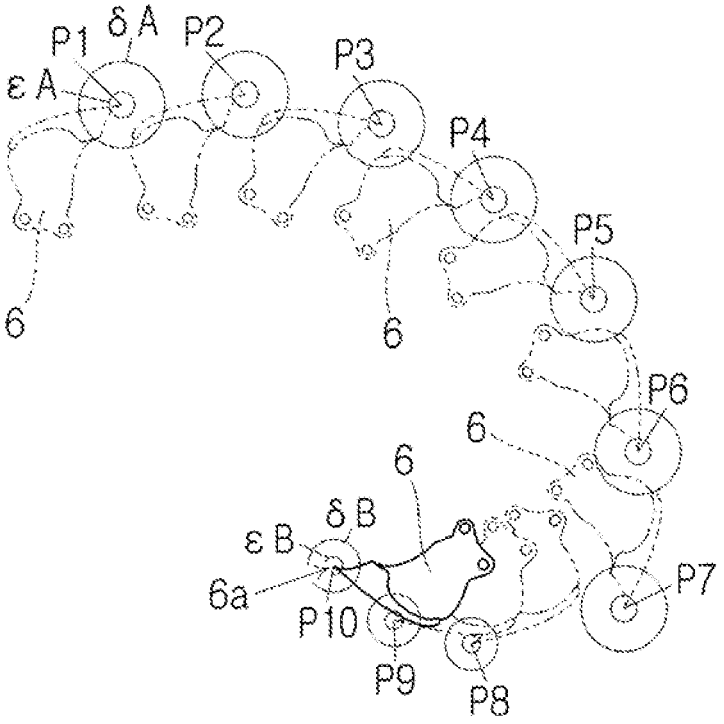
FIG. 4 is a diagram showing an example of a target track of a bucket. (Second example embodiment)

The target track storage unit 30 stores the target track of the bucket 6. FIG. 4 shows an example of the target track of the bucket 6. The target track of FIG. 4 is a track of the bucket 6 for excavating the residual soil accumulated in the earth and sand pit and accommodating it in the bucket 6. The target track of FIG. 4 is configured with a plurality of discretized target states P1 to P10 of the bucket 6. Each target state P1 to P10 includes at least the target X coordinate xr and the target Y coordinate yr, which are the target coordinates of the bucket cutting edge 6*a* of the bucket 6. In this example embodiment, each of the target states P1 to P10 further includes a target absolute posture Or of the bucket cutting edge 6*a* of the bucket 6. Therefore, in this example embodiment, each of the target states P1 to P10 of the bucket 6 is configured with the target X coordinate xr, the target Y coordinate yr, and the target absolute posture Or of the bucket cutting edge 6*a* of the bucket 6. The track following control unit 22 controls the swing angles θ1, θ2, and θ3 so that the state of the bucket 6 sequentially follows the target states P1 to P10.

FIG. 5 shows a plurality of discretized target states P1 to P10 of the bucket 6. In FIG. 5, the target X coordinate xr of the bucket cutting edge 6*a* of the bucket 6 corresponding to the target state Pn is represented by xr(n), the target Y coordinate yr thereof is represented by yr(n), and the target absolute posture θr thereof is represented by θr(n). Here, n is an integer from 1 to 10.

The target state update unit 31 refers to the table shown in FIG. 5 to set the target state of the bucket 6 at the start of the following control and to update the target state of the bucket 6 as the following control progresses.

The target relative posture calculation unit 32 calculates the respective target swing angles θr1, θr2, and θr3 based on the current target state of the bucket 6. The specific calculation method should be seen in the above expressions (4) to (12). In FIG. 5, the target swing angle θr1 corresponding to the target state Pn is represented by the target swing angle θr1(*n*). The target swing angle θr2 corresponding to the target state Pn is represented by the target swing angle θr2(*n*). The target swing angle θr3 corresponding to the target state Pn is represented by the target swing angle θr3(*n*).

The relative posture control unit 33 controls the swing angles θ1, θ2, and θ3 so that the swing angles θ1, θ2, and θ3 approach the corresponding target swing angles θr1, θr2, and θr3, respectively.

Returning to FIG. 3, the convergence determination unit 34 determines whether the state of the bucket 6 has converged to the current target state. The convergence determination unit 34 includes a first convergence determination unit 35 and a second convergence determination unit 36.

The first convergence determination unit 35 determines whether the swing angle corresponding to the relative posture of respective mechanisms have converged to the corresponding target swing angles θr1, θr2, and θr3 under the first convergence condition. The second convergence determination unit 36 determines whether the swing angles corresponding to the relative postures of the respective mechanisms have converged to the corresponding target swing angles θr1, θr2, and θr3 under the second convergence condition, which is stricter than the first convergence condition.

Here, the relative posture of the boom 4 is a swing angle θ1. The relative posture of the arm 5 is a swing angle θ2. The relative posture of the bucket 6 is a swing angle θ3.

In FIG. 4, the first constraint condition is imaged by a circle represented by δA and δB, and the second constraint condition is imaged by a circle represented by εA and εB. Note that the targets of the convergence determination under the first convergence condition and the second convergence condition are just the swing angles θ1, θ2, and θ3 of the boom 4, the arm 5, and the bucket 6, respectively. It should be noted that, in FIG. 4, in order to promote understanding, the target of the convergence determination under the first constraint condition and the second constraint condition is drawn as if it were the coordinate of the bucket cutting edge 6*a* of the bucket 6.

FIG. 5 shows first threshold values δ to be used in the convergence determination under the first constraint condition and second threshold values c to be used in the convergence determination under the second constraint condition. The first threshold values δ and the second threshold values c are set for respective mechanisms and also for respective target states. The first threshold values M and the second threshold values ε1 shown in FIG. 5 are threshold values to be used for the convergence determination of the swing angles θ1 of the boom 4. Similarly, the first threshold values δ2 and the second threshold values ε2 are threshold values to be used for the convergence determination of the swing angles θ2 of the arm 5, and the first threshold values δ3 and the second threshold values ε3 are threshold values to be used for the convergence determination of the swing angles θ3 of the bucket 6.

In this example embodiment, a single first threshold value δ1 (A) is adopted as the first threshold value δ1 to be used in the target states P1 to P7. Similarly, a single first threshold value δ2 (A) is adopted as the first threshold value δ2 to be used in the target states P1 to P7, and a single first threshold value δ3 (A) is adopted as the first threshold value δ3 to be used in the target states P1 to P7.

A single first threshold value M (B) is adopted as the first threshold value M to be used in the target states P8 to P10. Similarly, a single first threshold value δ2 (B) is adopted as the first threshold value δ2 to be used in the target states P8 to P10, and a single first threshold value δ3 (B) is adopted as the first threshold value δ3 to be used in the target states P8 to P10.

The first threshold value δ1 (A) is greater than the first threshold value δ1 (B). The first threshold value δ2 (A) is greater than the first threshold value δ2 (B). The first threshold value δ3 (A) is greater than the first threshold value δ3 (B). Each first threshold value δ is a threshold value to be used for the convergence determination, and is compared with the deviation from each target value. Therefore, if the first threshold value δ is greater, the convergence determination condition is looser.

As described above, the first constraint condition is loosely set in the earlier stage of the target track of the bucket 6, and the first constraint condition is set strictly in the later stage thereof. This is because, when the bucket 6 excavates the earth and sand, the track of the bucket 6 is not required to have high accuracy for the bucket 6 approaching the earth and sand while the track of the bucket 6 is required to have high accuracy for the bucket 6 actually excavating it.

Returning to FIG. 5, in this example embodiment, a single second threshold value ε1 (A) is adopted as the second threshold value ci used in the target states P1 to P7. Similarly, a single second threshold value ε2 (A) is adopted as the second threshold value ε2 used in the target states P1 to P7, and a single second threshold value ε3 (A) is adopted as the second threshold value ε3 used in the target states P1 to P7.

A single second threshold value ci (B) is adopted as the second threshold value ci used in the target states P8 to P10. Similarly, a single second threshold value ε2 (B) is adopted as the second threshold value ε2 used in the target states P8 to P10, and a single second threshold value ε3 (B) is adopted as the second threshold value ε3 used in the target states P8 to P10.

The second threshold value ε1 (A) is greater than the second threshold value ε1 (B). The second threshold value ε2 (A) is greater than the second threshold value ε2 (B). The second threshold value ε3 (A) is greater than the second threshold value ε3 (B). Each second threshold value c is a threshold value used for the convergence determination, and is compared with the deviation from each target value. Therefore, if the second threshold value c is greater, the convergence determination condition is looser.

The first convergence determination unit 35 determines whether the swing angles corresponding to the relative postures of the respective mechanisms have converged to the corresponding target swing angles θr1, θr2, and θr3 under the first convergence condition based on the following expression (13).

[Expression 13]

$$|\theta_r^i-\theta^i|<\delta^i \tag{13}$$

In the above expression (13), the first term on the left side is the target swing angle θri. The second term on the left side is the current swing angle θi of each mechanism. The right side is the first threshold value δi. In each case, the subscript i is an integer from 1 to 3.

The second convergence determination unit 36 determines whether the swing angles corresponding to the relative postures of the respective mechanisms have converged to the corresponding target swing angles θr1, θr2, and θr3 under the second convergence condition based on the following expression (14).

[Expression 14]

$$|\theta_r^i-\theta^i|<\varepsilon^i \tag{14}$$

In the above expression (14), the right side is the second threshold value εi.

The first threshold value δ is set greater than the second threshold value ε. That is, the first threshold value δi (A) is greater than the second threshold value εi (A), and the first threshold value δi (B) is greater than the second threshold value εi (B).

With the above configuration, when the convergence determination unit 34 determines that the state of the bucket 6 has converged to the current target state, the target state update unit 31 updates the target state of the bucket 6 so that the target state of the bucket 6 becomes the next target state.

Figure 6:
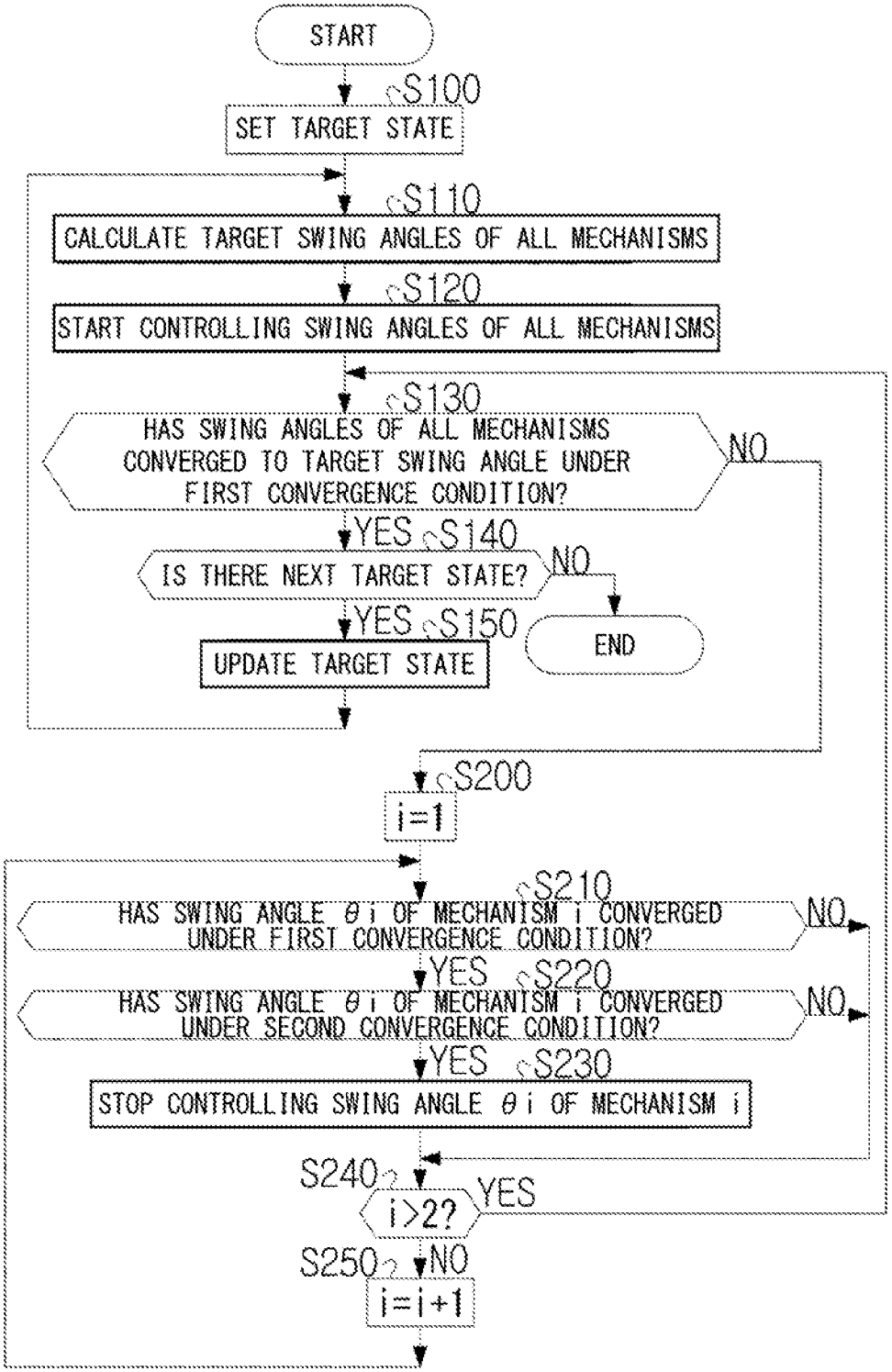
FIG. 6 is a control flow of the backhoe. (Second example embodiment)

Next, the control flow of the backhoe 1 is described below with reference to FIG. 6.

S100:

First, the target state update unit 31 sets the target state of the bucket 6 to the target state P1.

S110: Next, the target relative posture calculation unit 32 calculates the respective target swing angles θr1, θr2, and θr3 of all the mechanisms based on the current target state set by the target state update unit 31.

S120:

Next, the relative posture control unit 33 starts controlling the swing angles θ1, θ2, and θ3 of all the mechanisms so that the swing angles θ1, θ2, and θ3 of all the mechanisms approach the corresponding target swing angles θr1, θr2, and θr3, respectively. The control of the swing angle may be changing the swing angle of the mechanism. The control of the swing angle may include changing the control speed for changing the swing angle. The change in control speed may be decreasing or increasing the control speed. The relative posture control unit 33 may decrease the control speed of the mechanism when continuously controlling the relative posture of the mechanism so that the swing angle of the mechanism, which has converged under the first convergence condition, further approaches to the corresponding target swing angle.

S130:

Next, the first convergence determination unit 35 determines whether the swing angles θ1, θ2, and θ3 of all the mechanisms have converged to the corresponding target swing angles θr1, θr2, and θr3 under the first convergence condition. If YES in S130, the first convergence determination unit 35 advances the process to S140. Contrarily, if NO in S130, the first convergence determination unit 35 advances the process to S200.

S140:

The target state update unit 31 determines whether there is the next target state. If NO in S140, the track following control unit 22 ends the processing. Contrarily, if YES in S140, the target state update unit 31 advances the process to S150.

S150: The target state update unit 31 updates the target state of the bucket 6 to the next target state, and returns the process to S110.

S200-S250:

The processes from S210 to S230 are executed independently for each mechanism i. Each of the processes in S200, S240, and S250 is a loop processing for execution of processing independently for each mechanism i. The mechanism 1, the mechanism 2, and the mechanism 3 correspond to the boom 4, the arm 5, and the bucket 6, respectively.

S210:

The first convergence determination unit 35 determines whether the swing angle θi of the mechanism i has converged to the target swing angle θri under the first convergence condition. If YES in S210, the first convergence determination unit 35 advances the process to S220. Contrarily, if NO in S210, the first convergence determination unit 35 advances the process to S240.

S220:

The second convergence determination unit 36 determines whether the swing angle θi of the mechanism i has converged to the target swing angle θri under the second convergence condition. If YES in S220, the second convergence determination unit 36 advances the process to S230. Contrarily, if NO in S220, the second convergence determination unit 36 advances the process to S240.

S230:

The relative posture control unit 33 decreases the control speed of the swing angle θi of the mechanism i and stops the control of the swing angle θi.

S240:

When the processes from S210 to S230 are executed for all the mechanisms i in S240, the track following control unit 22 returns the processes to S130.

According to the processes from S210 to S230, the relative posture control unit 33 controls in the following manner when preconditions (1) and (2) described below are satisfied. That is, the relative posture control unit 33 continuously controls the swing angle of the mechanism so that the swing angle of the mechanism, which has already converged to the corresponding target swing angle under the first convergence condition, further approaches the corresponding target swing angle. The precondition (1) is that the swing angle of at least one of the mechanisms has converged to the corresponding target swing angle under the first convergence condition. The precondition (2) is that the swing angle of at least one of the other mechanisms has not converged to the corresponding target swing angle under the first convergence condition. The above control can smooth the operation of the boom 4, the arm 5, and the bucket 6, of the backhoe 1. The reason is as follows.

The timing at which the swing angles of the plurality of mechanisms converge to the corresponding target swing angles under the first convergence condition usually differs from each other. Therefore, if an individual mechanism has the speed decreased and then is stopped as soon as the swing angle converges to the corresponding target swing angle under the first convergence condition, what takes place is the following: the mechanism whose swing angle has converged to the target swing angle before the other mechanisms must stand by with the angle change in the swing angle set to zero until the swing angles of all the other mechanisms converge to the target swing angles under the first convergence conditions. In other words, it is necessary to temporarily stop the change in the joint angle between the mechanisms. If the change in the joint angle between the mechanisms is temporarily stopped in this way, the change and the stop are repeated, and the operation of the boom 4, the arm 5, and the bucket 6 of the backhoe 1 becomes awkward.

In contrast, in this example embodiment, the angle change is not immediately decelerated and stopped when the swing angle of an individual mechanism converges to the corresponding target swing angle under the first convergence condition, which results in as follows: the angle change in the swing angle of the mechanism, the swing angle of which has converged to the target swing angle under the first convergence condition before the other mechanisms, is maintained after the convergence as well. In other words, it is less necessary to temporarily stop the change in the joint angle between the mechanisms. This can smooth the operation of the boom 4, the arm 5, and the bucket 6 of the backhoe 1.

The above-described second example embodiment has the following features.

The track following control unit 22 (track following system) controls the bucket 6 to follow the target track in the backhoe 1 (work machine) provided with a plurality of mechanisms. The plurality of mechanisms include a bucket 6 (end effector), and a boom 4 and an arm 5 that support the bucket 6 (at least one support unit). The track following control unit 22 includes a target state update unit 31, a target relative posture calculation unit 32, a relative posture control unit 33, and a convergence determination unit 34. The target state update unit 31 updates the target state including at least the target coordinates of the bucket 6. The target relative posture calculation unit 32 calculates each of the target swing angles (target relative postures) of the plurality of mechanisms based on the current target state of the bucket 6. The relative posture control unit 33 controls the swing angles of the plurality of mechanisms so that each of the swing angles (relative postures) of the plurality of mechanisms approaches the corresponding target swing angle. The convergence determination unit 34 determines whether the state of the bucket 6 has converged to the current target state. The target state update unit 31 is configured to update the target state of the bucket 6 when the convergence determination unit 34 determines that the state of the bucket 6 has converged to the current target state. The convergence determination unit 34 includes a first convergence determination unit 35 and a second convergence determination unit 36. The first convergence determination unit 35 determines whether the swing angle of each mechanism has converged to the corresponding target swing angle under the first convergence condition. The second convergence determination unit 36 determines whether the swing angle of each mechanism has converged to the corresponding target swing angle under the second convergence condition, which is stricter than the first convergence condition. According to the above configuration, a new technique relating to convergence determination is provided. That is, a flexible convergence determination can be achieved.

In addition, the convergence determination unit 34 determines that the state of the bucket 6 has converged to the current target state when the swing angles of all the mechanisms have converged to the corresponding target swing angles under the first convergence condition.

Furthermore, when the swing angle of at least one of the mechanisms has converged to the corresponding target swing angle under the first convergence condition, and when the swing angle of at least one of the other mechanisms has not converged to the corresponding target swing angle under the first convergence condition, the relative posture control unit 33 does the following: continuously controlling the swing angle of the mechanism so that the swing angle of the mechanism, which has already converged to the corresponding target swing angle under the first convergence condition, further approaches the corresponding target swing angle. According to the above configuration, the operation of each mechanism can be smoothed.

Then, the relative posture control unit 33 stops the control of the swing angle of each mechanism when the swing angle of each mechanism converges to the corresponding target swing angle under the second convergence condition.

In addition, the target state of the bucket 6 further includes the target absolute posture of the bucket 6.

A track following method includes a target state update step (S150), a target relative posture calculation step (S110), a relative posture control step (S120), and a convergence determination step (S130, S210, S220). The target state update step (S150) updates the target state of the bucket 6 when the convergence determination step determines that the state of the bucket 6 has converged to the current target state (S130: YES). The convergence determination step (S130, S210, S220) includes a first convergence determination step (S210) and a second convergence determination step (S220). The first convergence determination step (S210) determines whether the swing angle of each mechanism has converged to the corresponding target swing angle under a first convergence condition. The second convergence determination step (S220) determines whether the swing angle of each mechanism has converged to the corresponding target swing angle under a second convergence condition, which is stricter than the first convergence condition. According to the above method, a new technique relating to determining convergence is provided. That is, a flexible convergence determination can be achieved.

In the above example, the program can be stored using various types of non-transitory computer readable media, and can be supplied to a computer. Non-transitory computer readable media include various types of tangible storage media. Examples of non-transitory computer readable media include magnetic recording media (for example, flexible disks, magnetic tapes, hard disk drives), magneto-optical recording media (for example, magneto-optical disks). Examples of non-transitory computer readable media further include CD-ROMs (Read Only Memories), CD-Rs, CD-R/Ws, and semiconductor memories (for example, mask ROMs). Examples of non-transitory computer readable media further include PROMs (Programmable ROMs), EPROMs (Erasable PROMs), flash ROMs, RAMs (random access memories). The program may also be supplied to the computer by various types of transitory computer readable media. Examples of transitory computer readable media include electric signals, optical signals, and electromagnetic waves. The transitory computer readable media can supply the program to the computer via wired communication paths such as electric wires and optical fibers, or wireless communication paths.

Although the invention of the present application is described above with reference to the example embodiments, the invention of the present application is not limited to the above. In the configuration and details of the invention of the present application, various changes that can be understood by those skilled in the art can be made within the scope of the invention.

This application claims the priority based on Japanese Patent Application No. 2019-014687 filed on Jan. 30, 2019, and incorporates its disclosures herein in its entirety.

REFERENCE SIGNS LIST

100 track following system
101 target state update unit
102 target relative posture calculation unit
103 relative posture control unit
104 convergence determination unit
105 first convergence determination unit
106 second convergence determination unit

What is claimed is:

1. A track following system configured to automatically control an end effector to follow a target track in a work machine having a plurality of mechanisms including the end effector and at least one support member configured to support the end effector, the target track being configured with a plurality of discretized target states of the end effector, each target state including at least a target coordinate of the end effector, the track following system comprising:

a processor; and a memory storing instructions executable by the processor to:

set a current target state of the end effector;

calculate respective target relative postures of the plurality of mechanisms based on the current target state of the end effector;

control relative postures of the plurality of mechanisms so that the relative posture of each of the plurality of mechanisms approaches a corresponding target relative posture;

determine whether a state of the end effector has converged to the current target state; and change the current target state of the end effector so that the current target state is set to a next target state according to the plurality of discretized target states of the end effector, the plurality of discretized target states defining the target track, when the state of the end effector has been determined to have converged to the current target state, wherein determination of whether the state of the end effector has converted to the current target state includes:

determination of whether the relative posture of each of the plurality of mechanisms has converged to the corresponding target relative posture under a first convergence condition; and determining of whether the relative posture of each of the plurality of mechanisms has converged to the corresponding target relative posture under a second convergence condition that is stricter than the first convergence condition.

2. The track following system according to claim 1, wherein the state of the end effector is determined to have converged to the current target state when the relative postures of all the mechanisms have converged to the corresponding target relative postures under the first convergence condition.

3. The track following system according to claim 2, wherein, when the relative posture of a first mechanism of the mechanisms has converged to the corresponding target relative posture under the first convergence condition, and when the relative posture of a second mechanism of the mechanisms has not converged to the corresponding target relative posture under the first convergence condition, the relative posture of the first mechanism that has converged under the first convergence condition is continuously controlled so that the relative posture of the first mechanism further approaches the corresponding target relative posture.

4. The track following system according to claim 1, wherein control of the relative posture of any mechanism is stopped when the relative posture has converged to the corresponding target relative posture under the second convergence condition.

5. The track following system according to claim 1, wherein the target state of the end effector further includes a target absolute posture of the end effector.

6. A track following method for automatically controlling an end effector to follow a target track in a work machine having a plurality of mechanisms including the end effector and at least one support unit member configured to support the end effector, the target track being configured with a plurality of discretized target states of the end effector, each target state including at least a target coordinate of the end effector, the track following method performed by a computer and comprising:

setting a current target state of the end effector;

calculating respective target relative postures of the plurality of mechanisms based on the current target state of the end effector;

controlling relative postures of the plurality of mechanisms so that the relative posture of each of the plurality of mechanisms approaches a corresponding target relative posture;

determining whether a state of the end effector has converged to the current target state; and changing the current target state of the end effector so that the current target state is set to a next target state according to the plurality of discretized target states of the end effector, the plurality of discretized target states defining the target track, when the state of the end effector has been determined to have converged to the current target state, wherein determining whether the state of the end effector has converted to the current target state includes:

determining whether the relative posture of each of the plurality of mechanisms has converged to the corresponding target relative posture under a first convergence condition; and determining whether the relative posture of each of the plurality of mechanisms has converged to the corresponding target relative posture under a second convergence condition that is stricter than the first convergence condition.

7. A non-transitory computer readable medium storing a program for causing the computer to execute the track following method according to claim 6.

* * * * *